US005671888A

United States Patent [19]

Smith

[11] Patent Number: 5,671,888

[45] Date of Patent: Sep. 30, 1997

[54] SPRAY GUN WITH BARREL-MOUNTED VENTURI

[76] Inventor: Paul Smith, 35 Glengrove Avenue, West, Toronto, Ontario, Canada, M4R 1M5

[21] Appl. No.: 375,657

[22] Filed: Jan. 20, 1995

Related U.S. Application Data

[63] Continuation-in-part of Ser. No. 267,921, Jul. 6, 1994, abandoned.

[51] Int. Cl.[6] ..... B05B 7/24

[52] U.S. Cl. ..... 239/415; 239/419.5

[58] Field of Search ..... 239/290, 296, 239/300, 301, 415, 416.1, 419.5

[56] References Cited

U.S. PATENT DOCUMENTS

| | | | |
|---|---|---|---|
| 3,796,376 | 3/1974 | Farnsteiner | 239/419.5 X |
| 3,930,615 | 1/1976 | Farnsteiner | 239/419.5 |
| 5,044,557 | 9/1991 | Smith | 239/290 X |
| 5,064,119 | 11/1991 | Mellette | 239/300 X |
| 5,067,656 | 11/1991 | Copp, Jr. | 239/290 |
| 5,135,172 | 8/1992 | Toth | 239/300 X |
| 5,165,604 | 11/1992 | Copp, Jr. | 239/290 X |

FOREIGN PATENT DOCUMENTS

| | | | |
|---|---|---|---|
| 737021 | 5/1980 | U.S.S.R. | 239/412 |

*Primary Examiner*—Lesley D. Morris
*Attorney, Agent, or Firm*—Dowell & Dowell; Lynn Schumacher

[57] ABSTRACT

A high-volume, low-pressure spray gun operates from a conventional high pressure compressor. The gun has a barrel that supports a spray head, a handle that extends downwardly from the barrel, an inlet port at the bottom of the handle for receiving compressed air, and a passage in the handle directing compressed air toward the barrel. A venturi is mounted within the barrel and discharges a stream of compressed air downstream toward the spray head. The venturi entrains ambient air through orifices in the barrel. A valve mounted within the handle and operated with a trigger controls the flow of compressed air through the gun. The venturi is entirely separate from the trigger and the valve, and no complex linkage couples the trigger and valve, greatly simplifying construction. The venturi may be sealed to the passage in the handle to receive compressed air, and may be spaced from the barrel to allow entrainment of ambient air from the rear of the barrel.

19 Claims, 3 Drawing Sheets

SPRAY GUN WITH BARREL-MOUNTED VENTURI

This application is a continuation-in-part of application Ser. No. 08/267,921 filed on Jul. 6, 1994, and now abandoned.

FIELD OF THE INVENTION

The invention relates generally to spray guns operated with compressed air to spray liquids such as paint.

BACKGROUND OF THE INVENTION

Various spray guns are known. Some rely on high-pressure air flows, typically in the order of 50 pounds per square inch, to atomize and discharge liquids. Others rely on high-volume low-pressure (HVLP) air flows, typically under 10 pounds per square inch. HVLP flow are preferred as they result in a more efficient atomization of liquids and lower wastage of liquid.

One type of HVLP spray gun operates from an HVLP air source. Each gun is typically provided with its own air flow generator, which is not economical in plants where several guns are used. A custom HVLP air source for multiple guns can be provided. However, in establishments employing spray guns, a conventional compressor (a high pressure source) is often available for various applications and operating multiple guns from such a compressor is generally more cost-effective.

Another type of HVLP spray gun operates with a conventional compressor and uses air entrainment to produce HVLP flows. U.S. Pat. No. 3,796,376 to Farnsteiner describes an exemplary gun whose configuration is an industry standard. The gun has a barrel that carries a spray head and a handle that extends downwardly from the barrel. The handle has a flow passage that leads to the interior of the barrel and fitting that receives compressed air. A venturi mounted in the handle discharges a stream of the compressed air into the handle's flow passage. Several orifices are formed in the handle so that the stream of compressed air entrains secondary air into flow passage, increasing flow volume and decreasing operating pressure. Part of the air flow in the barrel is diverted into a liquid container suspended from the gun to force liquid into the spray head. A needle valve extends centrally along the interior of the barrel and engages a liquid jet in the spray head to control discharge of liquid. The air flows within the barrel are directed through passages in an air jet to atomize and spray the discharged liquid. An air valve is mounted in the handle to control the flow of compressed air. The venturi and orifices of the Farnsteiner gun are located at the bottom of the handle where a worker's hand will not interfere with air entrainment. To avoid lengthening the handle, the valve controlling compressed air flow is located within the venturi and seats against the venturi to shut off compressed air flows. A trigger operates both valves in sequence to ensure that paint is not introduced before atomizing air flows are established.

There are several shortcomings to the Farnsteiner gun. A complex linkage with as many as twenty components couples the trigger to the valve member. In guns that do not rely on air entrainment, the air valve has been conveniently mounted and operated along an axis transverse to the lengthwise axis of the handle and has been directly engaged by the trigger. The Farnsteiner linkage instead requires a long shaft or valve stem that extends lengthwise along the interior of the handle. To open the valve, motion of the trigger transverse to the lengthwise axis of the handle must be transformed into motion of the shaft downwardly along the lengthwise axis of the handle. In this process, bending forces are applied to the head of the shaft, which has been known to deform and jam the gun. The diameter of the handle is also considerably larger than that of conventional high pressure guns in order to accommodate the venturi and the HVLP flows produced within the handle, and persons with small hands, particularly female operators, find such guns unwieldy. To avoid further increasing the diameter of the handle and adding to the complexity of the linkage, the shaft is extended centrally through the venturi, which reduces the efficiency of the venturi. The linkage requires frequent lubrication and adjustment for proper operation. The position of the shaft head must, however, be adjusted blindly, and whether the shaft head is properly positioned is not known until the venturi is reinstalled and the gun tested. If the shaft head is set too high, one pull of the trigger can damage the shaft.

The shortcomings associated with the Farnsteiner gun have been addressed in later HVLP guns that also operate with conventional compressors. Such guns have large-diameter internal flow chambers in which compressed air can expand to produce a low pressure flow. A regulator is placed in the compressed air line leading to such a gun to maintain internal operating pressure at a desired low level. Such guns do not require a complex linkage between trigger and air valve and are comparatively robust. However, such guns require a compressor with a power rating considerably greater than that needed to operate guns that exploit air entrainment, and multiple guns can place considerable demand on a compressor.

SUMMARY OF THE INVENTION

In one aspect, the invention provides a spray gun comprising a spray head and a housing that directs air flows to the spray head. The housing comprises a barrel that supports the spray head, a handle that extends transversely from the barrel, and an inlet port that receives a flow of compressed air. An internal flow path directs the compressed air flow from the inlet port into the barrel and leads to the spray head. Ambient air is entrained into the barrel in response to the flow of compressed air. The air entraining means comprises a venturi mounted in the barrel and discharging directly into the barrel and one or more orifices formed in the barrel. Means are provided for delivering a liquid from a container to the spray head for discharge. The liquid delivery means may be conventional and may include a pressure line for pressurizing the container with the air flows within the barrel, a coupling for receiving liquid forced from the container and directing the liquid to the spray head, and an appropriate liquid valve operated by the trigger to control delivery of the liquid. An air valve is located in the flow path upstream of the venturi to shut off the flow of compressed air. A trigger controls the valve to selectively enable and disable the compressed air flow. The inlet port is preferably formed in the handle with an appropriate passage in the handle directing compressed air into the barrel. The air valve may then be conveniently mounted in the handle with the valve member that controls air flows acting along an axis transverse to the lengthwise axis of the handle and intersecting the trigger.

Several advantages are achieved over the prior art, particularly HVLP guns with the Farnsteiner construction. Mounting the venturi within the barrel or for discharge directly into the barrel permits the air valve to be entirely separate from the venturi. The operation of the venturi need not be impaired by passage of linkage centrally through the venturi. A complex linkage between trigger and air valve is not required. Instead the trigger can operate directly against the operative valve member and motion of the trigger along a particular axis toward the handle need not be transformed into movement of the valve member along a transverse axis extending lengthwise along the handle. Use of a simpler linkage reduces the incidence of jamming and the need for periodic adjustment. Since large volume air flows arise only in the barrel, through air entrainment, and since a linkage need not be extended lengthwise along the handle of the gun, there is freedom to use a handle with a comparatively narrow diameter.

In another aspect of the invention, the inlet port is located in the handle and the internal flow path includes a passage extending from the inlet port toward the barrel. The venturi comprises an inlet sealed to the passage to receive a compressed air flow along a first axis from the passage and an outlet that discharges directly into the barrel along a second axis transverse to the first axis. The venturi may comprise a circumferential side wall sealed to the barrel and the inlet may be formed in the side wall. The sealing may be achieved by forming the barrel and side wall of the venturi with mating screw threads. The venturi may alternatively comprise a sleeve which defines the inlet and extends into the passage. The venturi may be spaced from the barrel to define a passage permitting entrainment of the ambient air about the venturi into the barrel, essentially through a rear section of the barrel.

Various aspects of the invention will be apparent from a description below of preferred embodiments and will be more specifically defined in the appended claims.

DESCRIPTION OF THE DRAWINGS

The invention will be better understood with reference to drawings in which.

DESCRIPTION OF PREFERRED EMBODIMENTS

Figure 1:
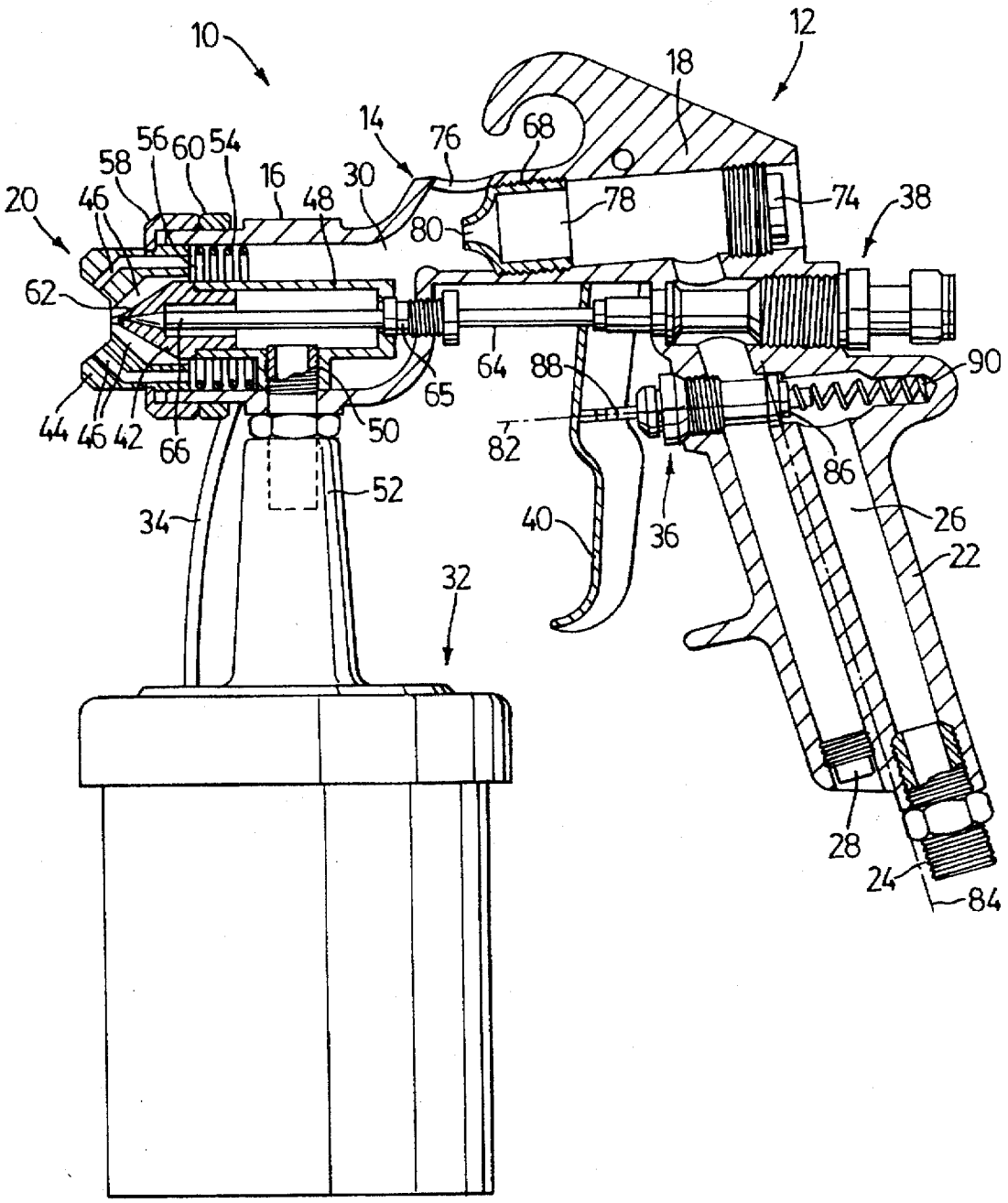
FIG. 1 is a cross-sectional view in a vertical plane of a spray gun.

An overview of a spray gun 10 embodying the invention will be provided with reference to FIG. 1. The gun 10 has a housing 12 which is preferably formed of a lightweight material such as aluminum or plastic. The housing 12 includes a barrel 14 with a forward section 16 and a rear section 18 that is offset upwardly relative to the forward barrel section 16. (For purposes of this specification, such offsetting should be understood as vertical spacing between central lengthwise axes of the barrel sections, and upward and downward directions should be understood with respect to the operative orientation of a gun.) A spray head 20 is mounted on the forward barrel section 16. A handle 22 extends downwardly from the rear barrel section 18 and carries an inlet port 24 for receipt of compressed air. The inlet port 24 is a conventional fitting appropriate for connection to a compressed air line (not shown). The housing 12 defines an internal flow path extending from the inlet port 24 to the spray head 20. The flow path includes a flow passage 26 extending the length of the handle 22 and formed as two separate passageways (not numbered), one receiving the inlet port 24 and the other closed with a threaded plug 28. The flow path also includes a passage 30 extending the length of the barrel 14 and communicating with the spray head 20. A liquid container 32 is suspended from the barrel and stores a liquid such as paint (not shown) which is delivered to the spray head 20 for atomization and discharge with air flows. A conduit 34 places the interior of the barrel in communication with the interior of the container 32 to force the liquid into the barrel and ultimately into the spray head 20. A regulator (not shown) may be installed in the conduit 34 to set an appropriate operating pressure for delivery of liquid. A conventional air valve 36 controls the flow of compressed air through the interior of the spray gun 10, and a conventional needle-type liquid valve 38 controls the flow of liquid to the spray head 20. A trigger 40 is pivoted to the rear barrel section 18 in a conventional manner and positioned to be engaged with the operator's hand that grips the handle 22. As in the prior art, the trigger 40 actuates the valves 36, 38 in sequence, enabling the flow of compressed air through the gun 10 just before enabling the discharge of liquid from the container 32.

Much of the construction of the spray head 20 is conventional and will not be described in detail. The spray head 20 has a liquid jet 42 that discharges liquid received from the container 32 and an air jet 44 that surrounds the liquid jet 42. The air jet 44 has passages 46 that discharge air flows from the barrel to atomize and spray the liquid. The liquid jet 42 is threaded into a mounting block 48 which is secured to the barrel with a hollow externally-threaded fitting 50. The fitting 50 supports an internally threaded outlet 52 of the container 32 and conveys liquid from the container 32 into the interior of the liquid jet 42. The air jet 44 is shaped to slide within the forward barrel section 16. It is urged forwardly by a biasing spring 54 that acts between the mounting block 48 (which carries abutments not apparent in the view of FIG. 1 that properly seat the spring 54) and an apertured plate 56 positioned against the rear of the air jet 44. An internally-threaded, centrally-apertured end cap 58 mates with an external thread (not indicated) of the barrel and secures the air jet 44 to the barrel against forward displacement. A collar 60, which is also threaded to the forward barrel section 16, locks the cap 58 against rotation and effectively fixes the position of the air jet 44 relative to the liquid jet 42. The spray pattern may be adjusted in a conventional manner by rotating the end cap 58 to displace the air jet 44 relative to the liquid jet 42.

The liquid jet 42 has internal surfaces that define a valve seat 62 of the liquid valve 38. A spring-biased needle 64 of the liquid valve 38 has a forward tip portion 66 that conforms in shape to and seats against the valve seat 62 to shut off the flow of liquid. The needle 64 is drawn rearwardly when the trigger 40 is drawn toward the handle 22 to release liquid from the liquid jet 42. It should be noted that the body of the liquid valve 38 is threaded into an upper end of the handle 22. The needle 64 is external to and below the rear barrel section 18. It extends into the forward barrel section 16 and into the interior of the mounting block 48 through a conventional adjustable packing assembly 65 that is threaded to the barrel 14 and engages a recessed rear surface of the mounting block 48. A similar arrangement has been used previously with high pressure guns that deliver compressed air directly to the associated spray head 20. The arrangement has a unique significance, however, to the spray gun 10 of the present invention. Keeping the needle 64 external to the rear barrel section 18 permits a venturi 68 to be mounted separately within the rear barrel section 18 where it can receive all compressed air flow without obstruction.

Figure 2:
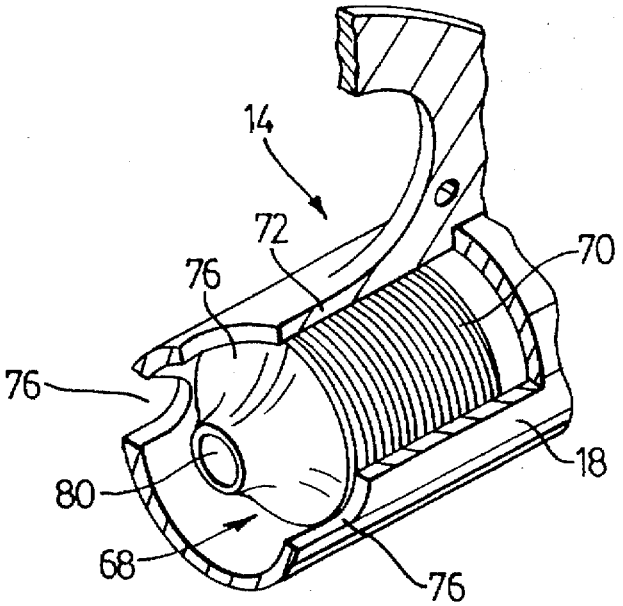
FIG. 2 is a fragmented perspective view of the barrel of the spray gun further detailing a venturi and orifices that cooperate to entrain air into the barrel.
Figure 3:
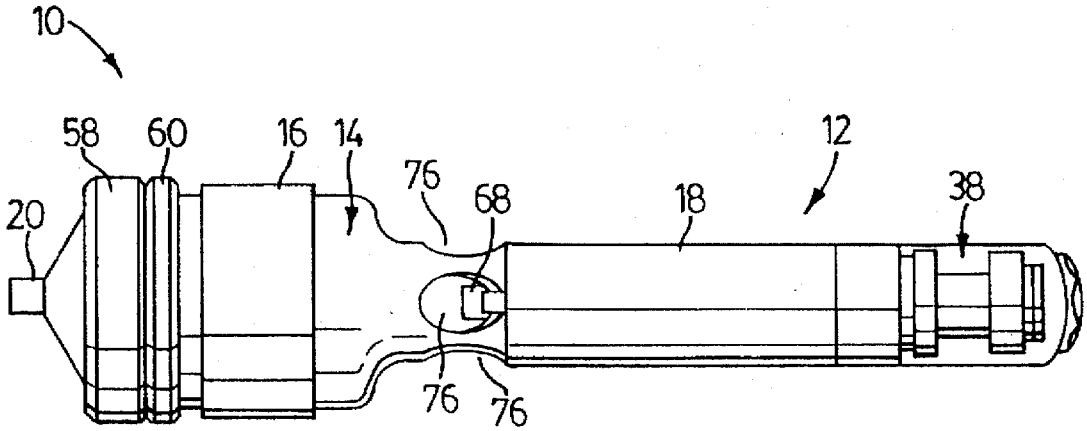
FIG. 3 is a plan view of the spray gun further indicating the position of the orifices formed in the barrel.

The compressed air flow is transformed into an HVLP flow within the barrel 14 itself. The venturi 68 has an external screw thread 70 that mates with an internal screw thread 72 formed in the interior of the barrel 14. The rear surface of the venturi 68 may be formed with diametrically oriented slots (not illustrated) so that a bladed tool such as a screw driver can be used to thread the venturi 68 into place or remove the venturi 68. During assembly, the venturi 68 is introduced from the rear end of the barrel 14, which is then closed with a threaded plug 74. Three orifices 76 (all indicated in FIGS. 2 and 3) are formed in the barrel 14 and surround the venturi 68. The venturi 68 has an inlet 78 that receives compressed air delivered along the flow path and an outlet 80 that discharges a stream of the compressed air downstream toward the spray head 20. The stream of compressed air entrains ambient air through the orifices 76 producing an HVLP air flow immediately downstream of the venturi 68. A filter (not shown) may be mounted about the barrel 14 in a conventional manner to prevent entrainment of dust with the ambient air. The HVLP air flow operates the spray head 20 and also pressurizes the liquid container 32.

The air valve 36 is threaded into the handle 22 along an axis 82 transverse to the lengthwise axis 84 of the handle 22 and intersecting the trigger 40. The air valve 36 comprises a valve member 86 that seats against the body of the valve 36 to shut off the compressed air flow. The valve member 86 has a stem 88 that projects forwardly from the valve body and the handle 22. A coil spring 90 urges the valve member 86 along the transverse axis 82 (to the left in the view of FIG. 1) to the flow-disabling position shown in FIG. 1. It simultaneously urges the valve stem 88 against the trigger 40. The trigger 40 is of course positioned to be engaged with the operator's fingers while the operator grips the handle 22. It pivots from an extreme position distant from the handle 22 (as shown in FIG. 1) to a position (not illustrated) proximate to the handle 22. This displacement occurs substantially along the transverse axis 82 (from left to right in FIG. 1) and forces the valve member 86 to the right to its full-enabling position (not illustrated). In this embodiment, the valve stem 88 is loosely engaged with the trigger 40 and the biasing spring 90 of the air valve 36 restores the trigger 40 to its extreme position.

The spray gun 10 has several advantages over the prior art. In particular, it will be noted that the venturi 68 is mounted within the barrel 14 completely separate from the air valve 36 and the trigger 40. The valve stem 88 does not extend through the venturi 68 so that venturi operation is not impaired. The valve member 86 is mounted horizontally (transverse to the handle's lengthwise axis 84) and directly engages the trigger 40. The complex linkage characteristic of the prior Farnsteiner gun, extending lengthwise through the handle, is eliminated. Since the valve member 86 displaces in the direction of trigger movement, the linkage is not subject to bending forces. An air valve might instead be mounted within the barrel 14 immediately upstream of the venturi 68, and a different trigger may be provided to actuate the valve, but an arrangement in which the valve is mounted within the handle 22 is considered the simplest and most reliable. The drawings do not specifically indicate a reduction in handle diameter. However, it will be noted that large volume flows are created within the barrel 14 and that no linkage must be accommodated centrally along the handle 22. The handle 22 can thus be dimensioned, within practical limits, as desired.

Figure 4:
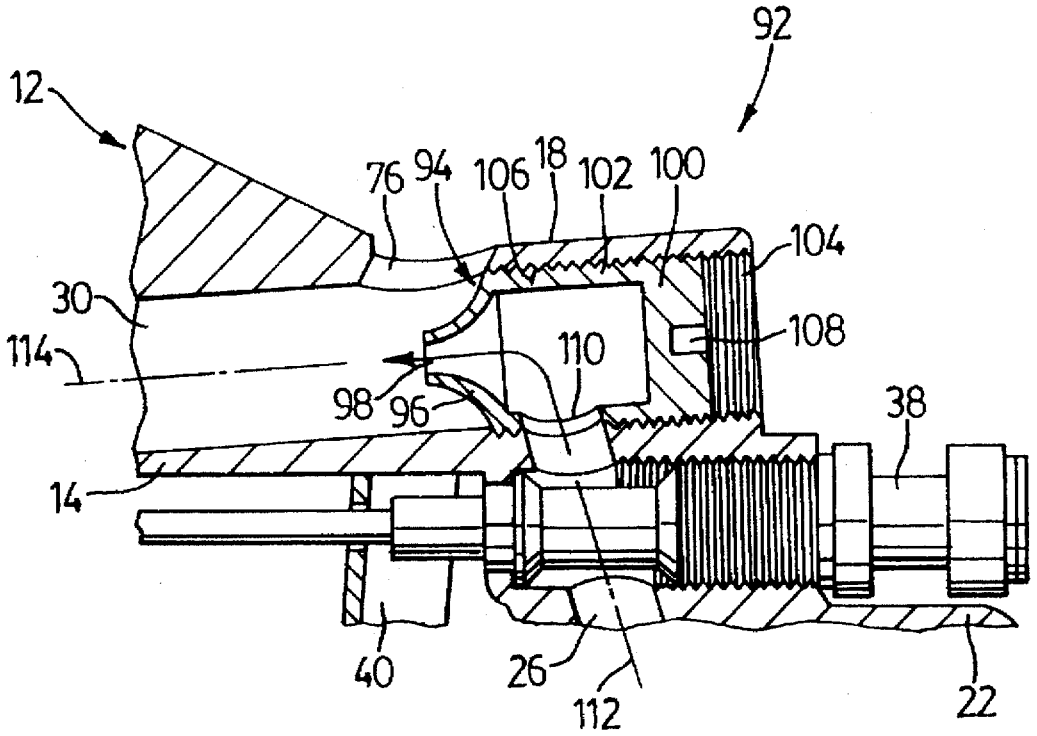
FIG. 4 is a fragmented cross-sectional view of the rear section of another spray gun showing a different venturi mounted within the barrel; and, FIG. 5 is a fragmented cross-sectional view of the rear section of yet another spray gun showing another venturi mounted within the barrel.

FIG. 4 shows features of another spray gun 92. Except for how ambient air is entrained into the spray gun 92, it is substantially identical to and operates in the same general manner as the spray gun 10. In FIG. 4, features common to the guns 10, 92 have been indicated with common reference numerals.

The spray gun 92 has a different venturi 94 which is now positioned further towards the rear end of the barrel 14. The venturi 94 has a forward portion 96 which defines an outlet 98, a rear portion 100, and circumferential side wall 102 between the forward and rear portions 96, 100. The side wall 102 is a circular cylinder with an external screw thread 104. The external screw thread 104 mates with an internal screw thread 106 of the barrel 14 effectively sealing the side wall 102 of the venturi 94 to the barrel 14 (preventing air flow between the forward and rear barrel sections 16,18). The rear portion 100 of the venturi 94 is formed with a slot 108 to receive a screw driver for purposes of installing the venturi 94 in the barrel 14. An inlet 110 is formed in the side wall 102 which receives the compressed air from the handle passage 26 along a receiving axis 112 through the handle 22. The inlet 110 is sealed to the passage 26 by the mated screw threads 104, 106, preventing leakage of compressed air past the venturi 94, and during installation the venturi 94 must be appropriately rotated to align the inlet 110 with the passage 26. The outlet 98 discharges the received compressed air forwardly and directly into the barrel 14 along an axis 114 transverse to the receiving axis 112. The venturi 94 is of course shaped to direct compressed air received from the passage 26 through the outlet 98, and a plug 28 in the rear of the barrel 14 is no longer required. Although the outlet 98 has been shown as only a single opening, the outlet 98 may comprise several openings.

Figure 5:
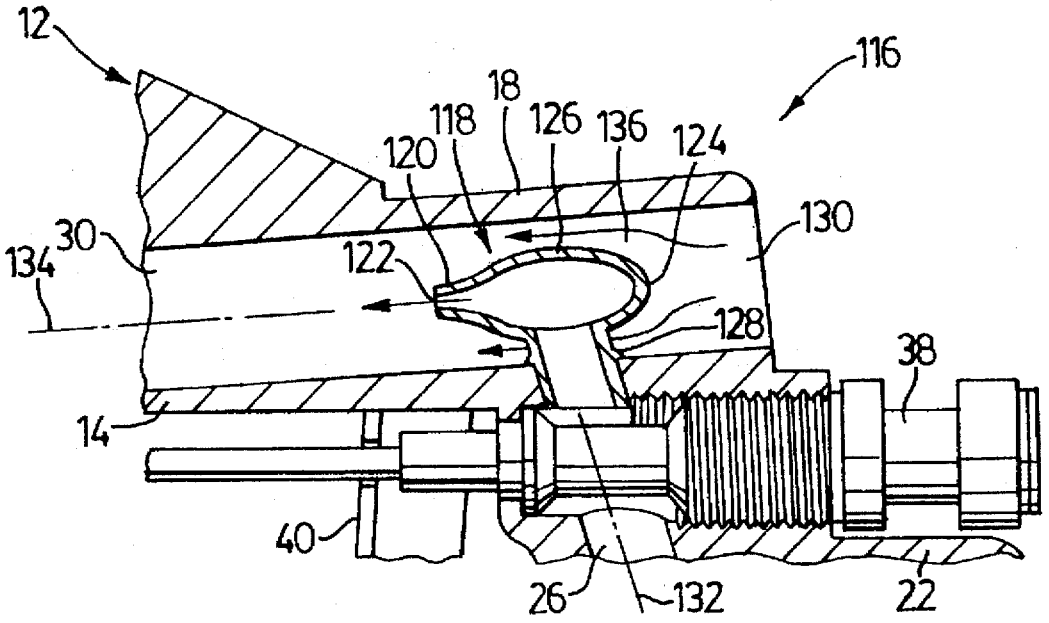

FIG. 5 shows pertinent details of yet another spray gun 116. The differences between this gun 116 and the spray gun 10 once again relate primarily to entrainment of ambient air, and only such differences are shown in FIG. 5. Components common to the guns 10, 116 have once again been indicated with common reference numerals.

The spray gun 116 has a venturi 118 with a forward portion 120 that defines an outlet 122, a rear portion 124, and circumferential side wall 126 between the forward and rear portions 120, 124. An inlet is defined by a mounting sleeve 128 that extends from the side wall 126 of the venturi 118 into the passage 26 in the handle 22. The mounting sleeve 128 is dimensioned to press-fit into the passage 26 to seal the inlet to the passage 26. In that regard, the entire venturi 118 is inserted through the rear opening 130 of the barrel 14 as with pliers, the sleeve 128 is aligned with the passage 26, and the venturi 118 force downwardly to seat the sleeve 128 within the passage 26. Compressed air is received once again along a receiving axis 132 extending along the handle 22 and discharged forwardly along an axis 134 transverse to the receiving axis 132. The three orifices 76 are now eliminated. Instead, the venturi 118 is spaced from the barrel 14 to define a passage 136 permitting ambient air to be entrained through the rear opening 130 of the barrel 14 about the venturi 118. Since orifices midway in the barrel 14 can be eliminated, this arrangement enhances the structural rigidity of the barrel 14. The arrangement also simplifies mounting of a filtering screen (not shown) for ambient air, which can now be installed in the rear opening 130 of the barrel 14.

The gun 116 may be further modified. The rear section 18 of the barrel 14 may in effect be shortened so that only the forward portion 120 of the venturi 118 actually protrudes into the barrel 14, once again discharging directly into the barrel 14. The sleeve 128 may be formed with an external screw thread that mates with an internal screw thread formed in the passage 26 of the handle 22 to seal the inlet defined by the sleeve 128 to the passage 26. The arrangement permits a tubular falter to be mounted to the rear of the barrel 14. The filter can be dimensioned to present a relatively large surface area to ambient air, reducing potential pressure drops and avoiding significant restrictions in air entrainment.

It will be appreciated that particular embodiments of the invention have been described and that modifications may be made therein without necessarily departing from the scope of the appended claims.

I claim:

1. A spray gun comprising:

a barrel having a lengthwise passage;

a handle extending transversely from the barrel, the handle comprising an inlet port for receiving a flow of compressed air and a passage for directing the flow of compressed air through the handle into the passage of the barrel;

a spray head mounted to the barrel and communicating with the passage of the barrel;

means for entraining ambient air into the passage of the barrel in response to the flow of compressed air, the air entraining means comprising a venturi mounted within the barrel and an orifice formed in the barrel;

means for delivering a liquid to the spray head for discharge through the spray head; and, means for controlling the flow of compressed air, the flow controlling means comprising an air valve mounted in the handle for shutting off the flow of compressed air along the flow path and a manually-operable trigger controlling the valve to selectively enable and disable the flow of compressed air.

2. The spray gun of claim 1 in which:

the handle has a lengthwise axis;

the trigger is manually displaceable transversely relative to the lengthwise axis between a position proximate to the handle and a position distant from the handle;

the air valve comprise a valve member displaceable along a predetermined axis transverse to the lengthwise axis of the handle and intersecting the trigger between a flow-enabling position in which the valve member allows the flow of compressed air along the flow path and flow-disabling position in which the valve member obstructs the flow of compressed air along the flow path and spring means urging the valve member to the flow-disabling position; and, the valve member has an end portion engaged with the trigger such that displacement of the trigger to its position proximate to the handle displaces the valve member to its flow-enabling position.

3. The spray gun of claim 1 in which:

the barrel comprises a forward section and a rear section offset upwardly relative to the forward barrel section, the spray head is attached to the forward barrel section and the venturi is mounted within the rear barrel section;

the spray head comprises a liquid jet; and, the liquid delivering means comprises a liquid valve operated by the trigger to control delivery of the liquid to the liquid jet, the liquid valve comprise a valve seat within the liquid jet and a needle with a forward tip portion shaped to seat against the valve seat, the needle extends externally of and below the rear barrel section and extends into the forward barrel section to the valve seat.

4. A spray gun comprising:

a spray head;

a housing comprising a barrel supporting the spray head, an inlet port for receiving a flow of compressed air spaced from the spray head and an internal air flow path directing the flow of compressed air from the inlet port into the barrel and leading into the spray head, the flow path having a spray head portion and a rear portion;

means for entraining ambient air into the barrel in response to the flow of compressed air, the air entraining means comprising a venturi mounted within the internal flow path in the rear portion thereof to discharge a stream of compressed air downstream into the flow path and an orifice formed in the barrel proximate to the venturi, the venturi having an inlet and an outlet, a sealed passage extends between the inlet port and the venturi inlet, the venturi is shaped to force the received compressed air through the venturi outlet;

means for delivering a liquid from a container to the spray head for discharge through the spray head, the liquid delivering means comprising a liquid flow path, the liquid flow path and the spray head portion of the air flow path have a common axis and the liquid flow path and the rear portion of the air flow path have separate spaced apart axes; and means for controlling the flow of compressed air, the flow controlling means comprising an air valve in the flow path upstream of the venturi for shutting off the flow of compressed air along the flow path and selectively enabling and disabling the flow of compressed air.

5. The spray gun of claim 4 in which the rear portion of the flow path is spaced above the spray head portion.

6. The spray gun of claim 5 in which the inlet port is formed in a handle extending transversely from the barrel and the air valve is positioned in the handle and a manually operated trigger controls the air valve.

7. The spray gun of claim 6 in which the liquid delivery means comprises a liquid valve operated by the trigger to control the delivery of the liquid to the liquid flow path, the trigger operably connected to a needle which selectively enables and disables the flow of liquid, the needle extending externally of and below the barrel.

8. A spray gun comprising:

a spray head;

a housing comprising a barrel supporting the spray head, a handle extending transversely from the barrel, an inlet port for receiving a flow of compressed air, and an internal flow path comprising a passage extending from the inlet port toward the barrel and directing the flow of compressed air form the inlet port into the barrel and leading to the spray head;

means for entraining ambient air into the barrel in response to the flow of compressed air, the air entraining means comprising a venturi mounted within the barrel to discharge a stream of the compressed air downstream into the flow path and an orifice formed in the barrel proximate to the venturi and the venturi comprising an inlet sealed to the passage to receive the compressed air flow along a first axis and an outlet for discharging the stream of compressed air along another second axis transverse to the first axis, the venturi being shaped to force the received compressed air flow through the outlet;

means for delivery a liquid from a container to the spray head for discharge through the spray head; and means for controlling the flow of compressed air, the flow controlling means comprising an air valve in the flow path upstream of the venturi for shutting off the flow of compressed air along the flow path and a manually-operable trigger controlling the air valve to selectively enable and disable the flow of compressed air.

9. The spray gun of claim 8 in which:

the barrel comprises a forward section and a rear section offset upwardly relative to the forward barrel section, the spray head is attached to the forward barrel section and the venturi is mounted within the rear barrel section;

the spray head comprises a liquid jet; and, the liquid delivering means comprises a liquid valve operated by the trigger to control delivery of the liquid to the liquid jet, the liquid valve comprises a valve seat within the liquid jet and a needle with a forward tip portion shaped to seat against the valve seat, the needle extends externally of and below the rear barrel section and extends into the forward barrel section to the valve seat.

10. The spray gun of claim 8 in which:

the trigger displaces between a predetermined position proximate to the handle and a predetermined position distant from the handle;

the air valve comprises a valve member displaceable along a predetermined axis intersecting the trigger between a flow-enabling position in which the valve member allows the flow of compressed air along the flow path and flow-disabling position in which the valve member obstructs the flow of compressed air along the flow path and spring means urging the valve member to the flow-disabling position; and, the valve member has an end portion engaged with the trigger such that displacement of the trigger to its position proximate to the handle displaces the valve member to its flow-enabling position.

11. The spray gun of claim 1 in which the venturi comprises a sleeve defining the inlet and extending into the passage.

12. The spray gun of claim 1 in which the orifice in the barrel is located rearwardly of the outlet of the venturi and the venturi is spaced from the barrel to define a passage permitting entrainment of the ambient air about the venturi into the barrel.

13. The spray gun of claim 8 in which the venturi comprises a circumferential side wall sealed to the barrel and the inlet is formed in the side wall.

14. The spray gun of claim 13 in which the barrel comprises an internal screw thread and the side wall of the venturi comprises an external screw threaded mated with the internal screw thread.

15. A spray gun comprising:

a spray head;

a housing comprising a barrel supporting the spray head, a handle extending transversely from the barrel, an inlet port attached to the handle for receiving a flow of the compressed air, and an internal flow path directing the flow of compressed air from the inlet port into the barrel and leading to the spray head, the internal flow path comprising a passage extending from the inlet port toward the barrel;

means for entraining ambient air into the barrel in response to the flow of compressed air, the air entraining means comprising a venturi comprising an inlet sealed to the passage to receive the compressed air flow along a first axis and an outlet that discharges a stream of the compressed air directly into the barrel along a second axis transverse to the first axis and an orifice formed in the barrel proximate to the venturi;

means for delivering a liquid from a container to the spray head for discharge through the spray head; and, means for controlling the flow of compressed air, the flow controlling means comprising an air valve mounted in the handle and in the passage for shutting off the flow of compressed air along the flow path and manually-operable trigger controlling the air valve to selectively enable and disable the flow of compressed air.

16. The spray gun of claim 15 in which the venturi comprises a sleeve defining the inlet and extending into the passage.

17. The spray gun of claim 15 in which the orifice in the barrel is located rearwardly of the outlet of the venturi and the venturi is spaced from the barrel to define a passage permitting entrainment of the ambient air about the venturi into the barrel.

18. The spray gun of claim 15 in which the venturi comprises a circumferential side wall sealed to the barrel and the inlet is formed in the side wall.

19. The spray gun of claim 18 in which the barrel comprises an internal screw thread and the side wall of the venturi comprises an external screw threaded mated with the internal screw thread.

* * * * *

UNITED STATES PATENT AND TRADEMARK OFFICE

CERTIFICATE OF CORRECTION

PATENT NO. : 5,671,888

DATED : September 30, 1997

INVENTOR(S) : Paul Smith

It is certified that error appears in the above-identified patent and that said Letters Patent is hereby corrected as shown below:

Claim 11, delete "1" and insert --8--.
Claim 12, delete "1" and insert --11--.

Signed and Sealed this

Twenty-third Day of December, 1997

Bruce Lehman

*Attest:*

BRUCE LEHMAN

*Attesting Officer*

*Commissioner of Patents and Trademarks*